United States Patent [19]

Shaffer

[11] Patent Number: 4,744,556

[45] Date of Patent: May 17, 1988

[54] ISOMETRIC MUSCLE EXERCISER

[76] Inventor: Eugene P. Shaffer, 243 La Follette Dr., Los Angeles, Calif. 90042

[21] Appl. No.: 61,918

[22] Filed: Jun. 11, 1987

[51] Int. Cl.[4] ..... A63B 23/00

[52] U.S. Cl. ..... 272/94; 272/95; 272/116; 128/25 R; 128/76 R

[58] Field of Search ..... 272/94, 95, 93, 119, 272/121, 125, 135, 137, 139, 116, 117; 128/25 R, 34, 76 R, 67, 60

[56] References Cited

U.S. PATENT DOCUMENTS

| | | | |
|---|---|---|---|
| 2,151,458 | 3/1939 | Allen | 128/76 R |
| 2,225,274 | 12/1940 | Mac Goun | 128/76 R |
| 2,791,999 | 5/1957 | Bustamante | 272/94 X |
| 3,457,914 | 7/1969 | Donaldson | 128/76 R |
| 3,497,217 | 2/1970 | Feather | 272/95 |
| 4,210,323 | 7/1980 | Feather | 272/137 |
| 4,280,696 | 7/1981 | Ramon | 272/95 |
| 4,549,536 | 10/1985 | Varjabedian | 128/60 |
| 4,585,012 | 4/1986 | Rumburg | 128/25 R X |

*Primary Examiner*—Richard J. Apley
*Assistant Examiner*—Howard Flaxman
*Attorney, Agent, or Firm*—Ronald W. Reagin; Stephen King

[57] ABSTRACT

An isometric chin, neck and jaw muscle exerciser is disclosed which includes a generally C-shaped structure having two free ends. One free end is adapted to fit within the mouth of the user, and the second free end fits under the chin. Weights are added to the structure to cause the second free end to press upward against the lower jaw and chin muscles, while at the same time exerting a resistance against the upper jaw muscles.

5 Claims, 2 Drawing Sheets

ISOMETRIC MUSCLE EXERCISER

BACKGROUND OF THE INVENTION

This invention relates to human muscle exercise equipment and, more particularly, to an isometric exerciser for muscles in the neck, jaw and chin areas to strengthen these muscles and to decrease the laxity of skin and tissues in these areas.

Over the years, several attempts have been made to provide an effective device for exercising neck muscles. Examples of such devices are disclosed in U.S. Pat. No. 2,791,999, issued May 14, 1957 to C. Bustamante; U.S. Pat. No. 3,457,914, issued July 29, 1969 to J. K. Donaldson; and U.S. Pat. No. 3,497,217, issued Feb. 24, 1970 to J. V. Feather.

In general, the prior art devices have been limited to the exercise of a limited number of muscles, and have been uncomfortable to use. Accordingly, it is an object of the present invention to provide a new and improved isometric muscle exerciser for muscles in the neck, jaw and chin areas.

It is another object of the invention to provide an isometric muscle exerciser which is comfortable to use and which exercises a wide range of muscles.

SUMMARY OF THE INVENTION

The foregoing and other objects of the invention are accomplished by providing a generally C-shaped structure having upper and lower horizontal members and a vertical member. The free end of the upper horizontal member is adapted to receive a mouthpiece which fits within the mouth of the user, and is held therein by the clamping action of the jaw muscles.

The free end of the lower horizontal member is adapted to extend under the chin of the user and to press against the lower jaw and neck muscles underneath the chin.

A fitting is provided for adding a weight to the structure at a location such that the weight causes the free end of the lower horizontal member to pivot upward and to press against the lower jaw and neck muscles underneath the chin. Regular use of the exerciser enables the user to gradually increase the amount of weight added to the structure. The exerciser acts to decrease the size of "double chins" and to narrow the cheeks.

Other objects, features, and advantages will become apparent from a reading of the specification taken in conjunction with the drawings, in which like reference numerals refer to like elements in the several views.

DESCRIPTION OF THE PREFERRED EMBODIMENTS

Figure 1:
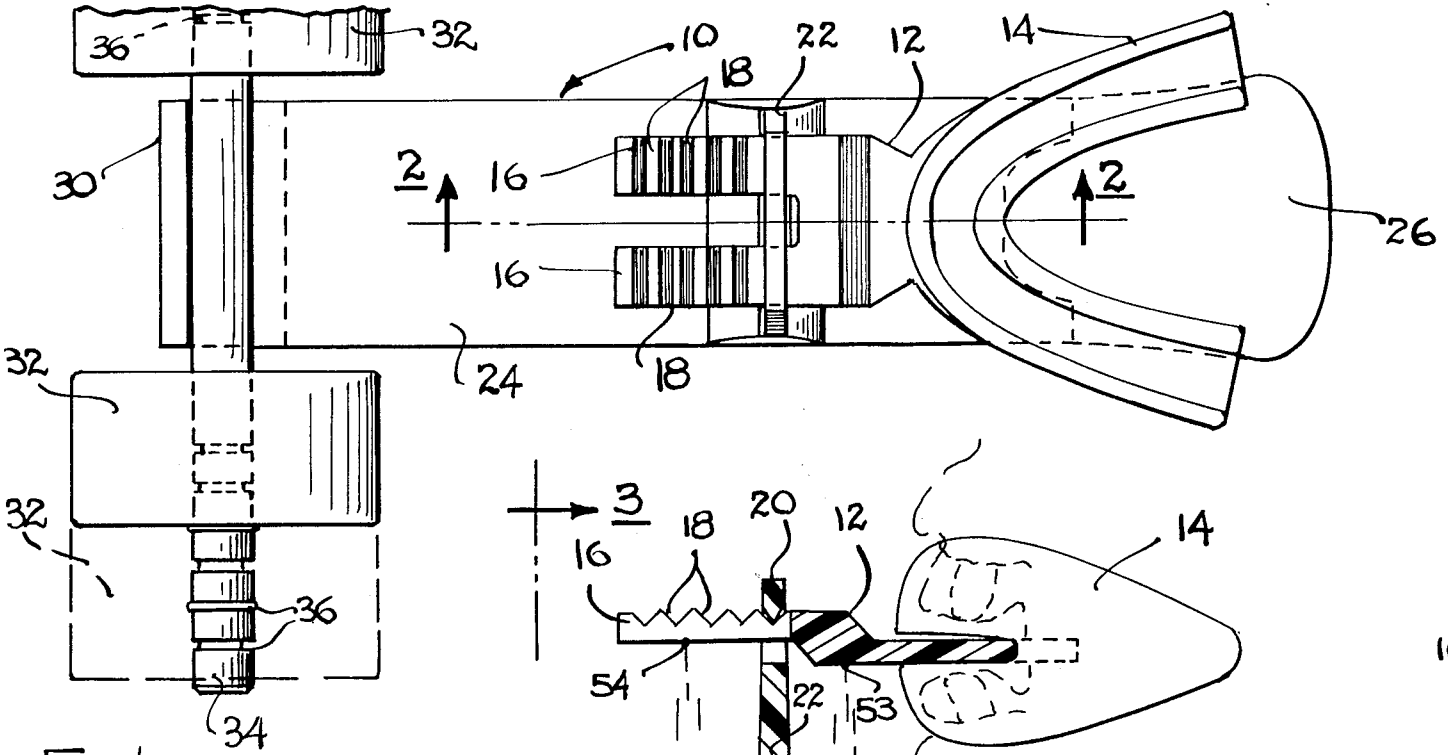
FIG. 1 is a top plan view of an exerciser constructed in accordance with the teachings of the invention.
Figure 2:
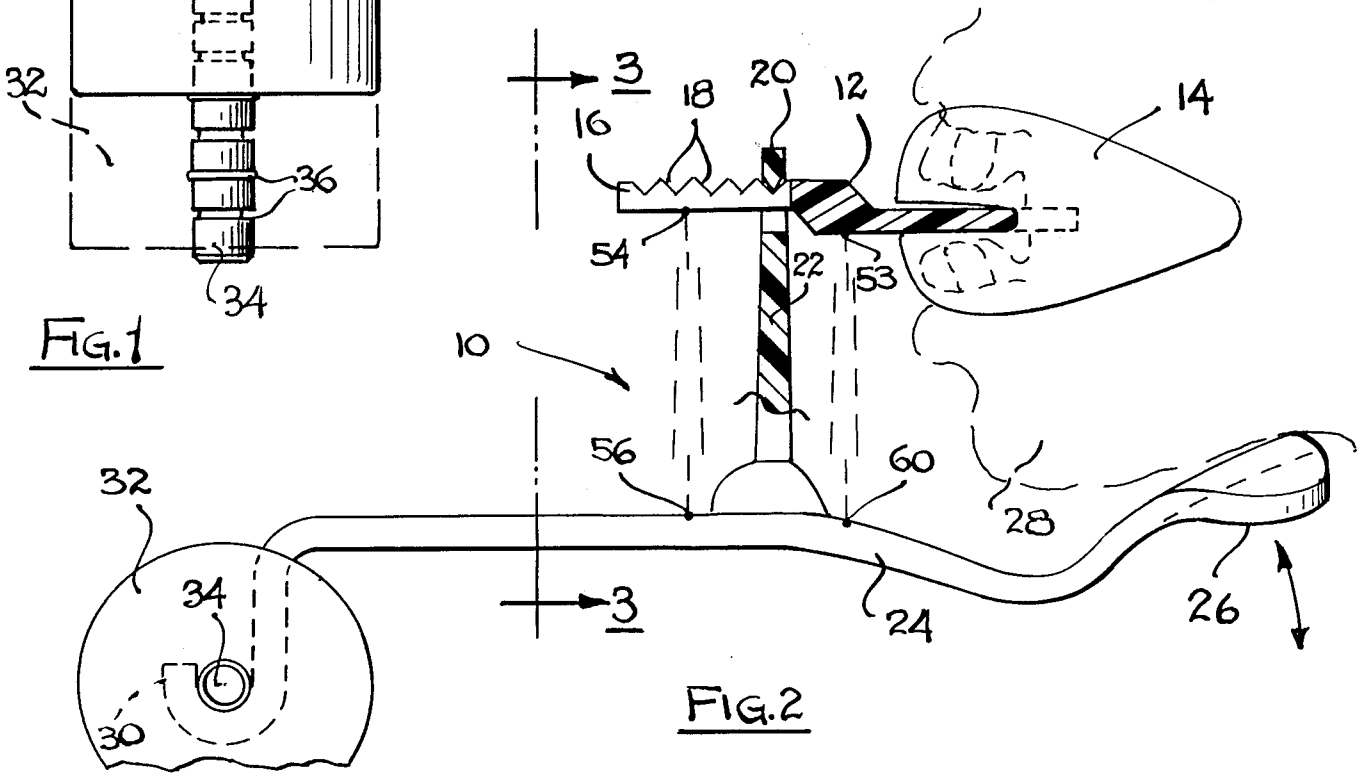
FIG. 2 is a side view in elevation of the exerciser of FIG. 1, showing it installed in the mouth of the user.
Figure 3:
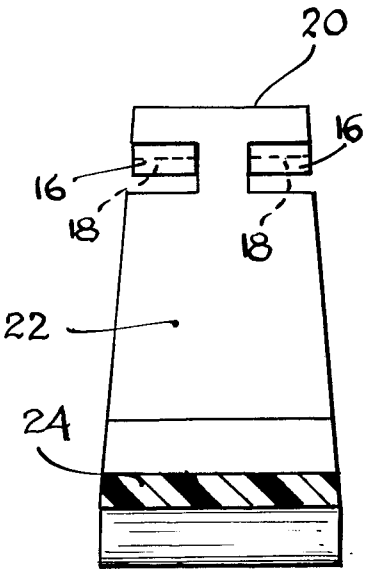
FIG. 3 is a side view, partially in cross-section, of the exerciser, taken along line 3—3 of FIG. 2.

FIGS. 1 and 2 are top and side views, respectively, of an isometric muscle exerciser 10 constructed in accordance with the invention.

The exerciser 10 is in the form of a generally C-shaped structure formed of plastic or similar material. An upper horizontal bar-shaped member 12 is adapted at one end to receive a pliable mouthpiece 14. The mouthpiece 14 may be of the type typically used as an athletic mouth protector. Such a protector is described in U.S. Pat. No. 3,768,465, issued Oct. 30, 1973 to N. D. Helmer.

The other end of the member 12 is forked, with each leg 16 of the fork having serrations 18 on the upper surface thereof. Fitting between the legs 16 is a T-shaped top end 20 of a bar-shaped vertical member 22. The end 20 is designed to fit within a serration 18 to form an adjustment for the exerciser as described below.

Affixed to the bottom end of the member 22 is a lower horizontal bar-shaped member 24. A free end 26 of the member 24 is adapted to extend under the chin of a user 28 when the mouthpiece 14 is in the user's mouth, as shown in FIG. 2.

The other end 30 of the member 24 is adapted to support a set of weights 32 which slip onto a bar 34 to form a miniature barbell. The end 30 is curled to support the center section of the bar 34. The weights 32 are slipped over the ends of the bar 34 and are held in place by a friction fit caused by O-rings 36 set into the bar 34.

The operation of the exerciser 10 is as follows. The mouthpiece 14 is inserted into the user's mouth, where it is held by the clamping action of the jaw muscles. The end 20 of the vertical member 22 is moved along the serrations 18 until the free end 26 of the member 24 rests comfortably under the chin of the user. Weights 32 are placed on the bar 34 which is then cradled in the looped end 30 of the member 24.

The weights 32 cause the member 22 to pivot about the point where the end 20 rests in the serrations 18, whereby the free end 26 pivots upward and presses against the lower jaw and neck muscles underneath the chin. The weights 32 cause the user to clench his teeth on the mouthpiece 14, which acts to strengthen the masseter and related jaw and neck muscles.

The upward directed force applied under the chin by end 26 provides positive resistance against the digastricus and related chin, jaw and neck muscles.

A typical exercise program for using the exerciser 10 is to start with a light weight 32 of about eight ounces, and to maintain the exerciser in place as described above for about 10 minutes a day. The amount of weight and length of use of the exerciser are then gradually increased with use, until several pounds of weight are comfortably tolerated for 30 minutes or more.

It has been found that, after a few months of use, the laxity of skin and tissue under the chin is reduced, thus acting to reduce what is commonly known as a "double chin." Further, the laxity of the skin and tissue in the cheek area is also reduced, acting to thin the facial features. The serrations 18 in cooperation with the end 20 act to adjust the distance between the mouthpiece 14 and the end 26 to accommodate different facial features among the users.

Figure 4:
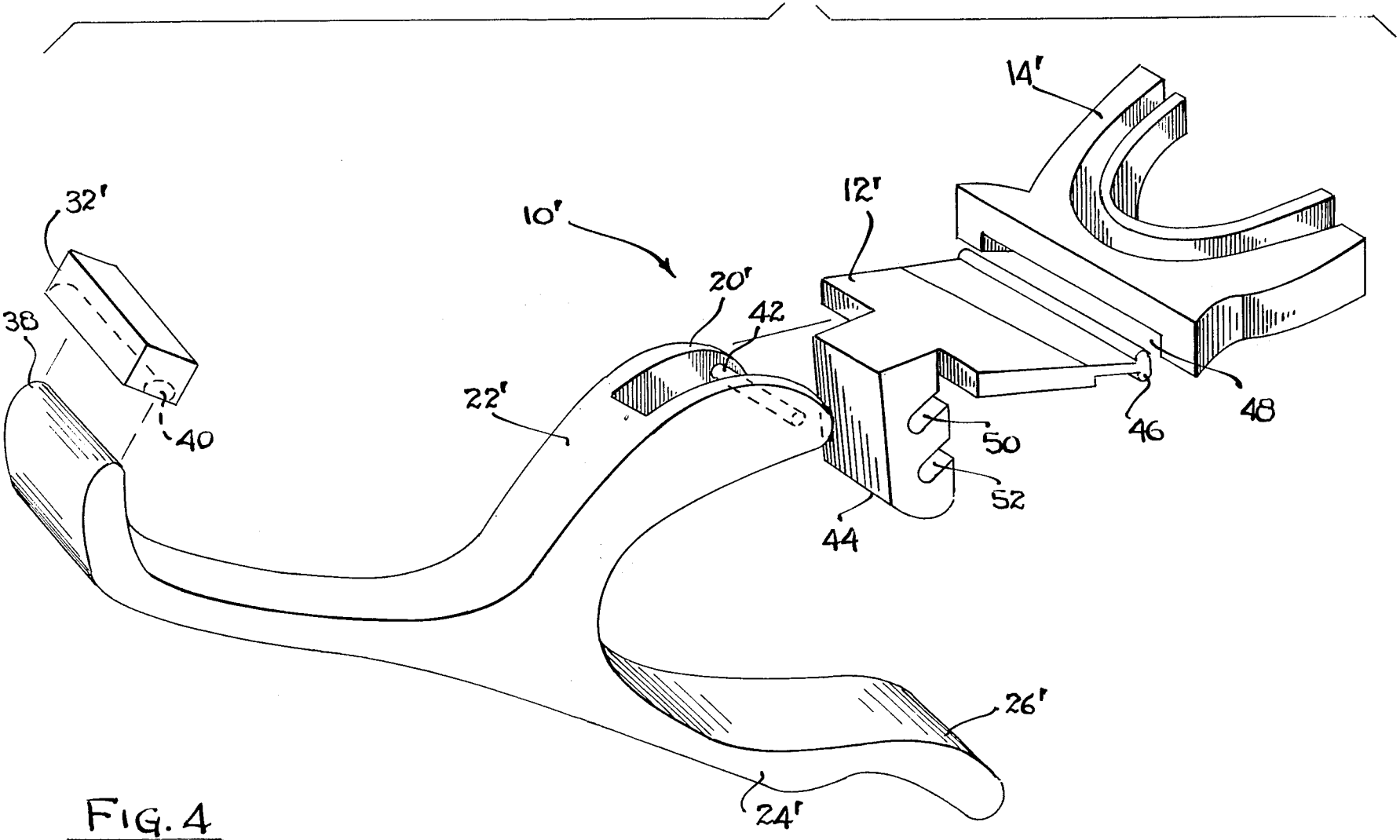
FIG. 4 is an exploded perspective view of an exerciser built in accordance with a second embodiment of the invention.

An alternate embodiment 10' of the invention is shown in FIG. 4. The embodiment 10' includes a generally C-shaped structure having a lower horizontal bar-shaped member 24' terminating at a free end 26' designed to fit under and press against the chin area as previously described for the end 26. The other end of the member 24' terminates in an upwardly extending tab 38 which is designed to fit within a corresponding recess 40 within a weight 32'.

A generally vertical member 22' extends upward from the member 24' and terminates in a forked top end 20'. A pin 42 extends between the legs of the fork 20'. An upper horizontal bar-shaped member 12' is provided which has one end flanged 46 to matingly engage with a recess 48 in a resilient mouthpiece 14'.

The other end of the member 12' terminates in a depending section 44 in which are provided canted slots 50 and 52. The section 44 is designed to fit between the legs of the fork 20' so that either the slot 50 or 52 can engage the pin 42 to provide a pivot point for the structure 10' much like the action of the serrations 18 and top end 20 in the previous embodiment.

In the embodiment 10', the distance between the mouthpiece 14 and the free end 26' may be adjusted by choosing either the slot 50 or 52 to engage the pin 42. The canted nature of the slots 50, 52 ensures that the pin 42 will not easily disengage from the slots 50, 52 when the exerciser 10' is in use.

The embodiment 10' is used in an identical fashion to the embodiment 10. Thus, the mouthpiece 14' is placed in the user's mouth which will result in the most comfortable position of the free end 26' under the chin. Weights 32' of various sizes are placed over the tab 38 to provide the desired muscle resistance.

While the embodiments described above employ weights to set muscle resistance, it is contemplated that other means may be employed. For example, referring to FIG. 2, a spring designed to exert a force in tension could be fastened between the points 54 and 56 in place of the weights 32, to provide resistance. Similarly, a spring designed to exert a force in compression could be fastened between the points 53 and 60 to accomplish a similar objective.

While there have been shown and described preferred embodiments of the invention, it is to be understood that various other adaptations and modifications may be made within the spirit and scope of the invention. It is thus intended that the invention be limited in scope only by the appended claims.

What is claimed is:

1. An isometric muscle exerciser, comprising:

a generally C-shaped structure having upper and lower horizontal members and a vertical member, where the free end of the upper horizontal member to be held by the mouth of a user using the clamping action of the jaw muscles, and where the free end of the lower horizontal member includes means for extending under the chin of the user and pressing against the lower jaw and neck muscles underneath the chin, wherein the vertical member pivotally connects the upper and lower horizontal members; and means for adding a weight to the structure at a location, external to the user's mouth, such that the weight causes the free end of the lower horizontal member to pivot with respect to the upper member and press upward against the lower jaw and neck muscles underneath the chin.

2. The exerciser of claim 1 further including means for adjusting the distance between the free ends of the upper and lower horizontal members.

3. An isometric muscle exerciser, comprising:

a generally C-shaped structure having upper and lower horizontal members and a vertical member, where the free end of the upper horizontal member includes a mouthpiece to be held by the mouth of the user using the clamping action of the jaw muscles, and where the free end of the lower horizontal member includes means for extending under the chin of the user and pressing against the lower jaw and neck muscles underneath the chin wherein the vertical member pivotally connects the upper and lower horizontal members;

adjustment means for varying the distance between the free ends of the upper and lower horizontal members; and bias means attached to the structure for biasing the free end of the lower horizontal member toward the free end of the upper horizontal member.

4. The exerciser of claim 3 where the bias means is a weight.

5. The exerciser of claim 4 where the bias means is a spring.

* * * * *